United States Patent [19]

Dubreux

[11] Patent Number: 4,734,161

[45] Date of Patent: Mar. 29, 1988

[54] PROCESS FOR A TWO STAGE PEROXIDE BLEACHING OF PULP

[75] Inventor: Bernard Dubreux, Francheville Le Bas, France

[73] Assignee: Atochem, France

[21] Appl. No.: 849,157

[22] Filed: Apr. 7, 1986

[30] Foreign Application Priority Data

May 29, 1985 [FR] France ..... 85 08291

[51] Int. Cl.[4] ..... D21C 9/16

[52] U.S. Cl. ..... 162/78; 162/80; 162/90

[58] Field of Search ..... 162/80, 78, 90, 76, 162/19

[56] References Cited

U.S. PATENT DOCUMENTS

| | | | |
|---|---|---|---|
| 2,865,701 | 12/1958 | Shroeder | 162/78 |
| 4,187,141 | 2/1980 | Ahrel | 162/80 |
| 4,294,575 | 10/1981 | Kowalski | 162/78 |

FOREIGN PATENT DOCUMENTS

| | | | |
|---|---|---|---|
| 3333219 | 3/1984 | Fed. Rep. of Germany | 162/78 |
| 52-63402 | 5/1977 | Japan | 162/78 |
| 55-45806 | 3/1980 | Japan | 162/78 |

*Primary Examiner*—Steve Alvo

*Attorney, Agent, or Firm*—Sigalos & Levine

[57] ABSTRACT

A two-stage hydrogen peroxide bleaching treatment of chemical pulp at a temperature of about 90°-100° C. comprising subjecting said pulp in a first stage to hydrogen peroxide and to at least about 3 grams/1 of bath of a metal ion sequestering agent selected from nitrogen containing sequestering agents or agents derived from polyphosphoric or polyphosphonic acids at a pH of 8.5 to 9.5 so that hydrogen peroxide of about 0.3 to 2.5 wt. % relative to dry pulp weight is consumed, and subjecting said pulp in a second stage to hydrogen peroxide and to at least about $3\times10^{-3}$ gram-atoms per 100 grams of dry pulp of magnesium in the form of magnesium hydroxide and a pH of at least about 11 so that about 2 to 5 weight % of hydrogen peroxide per weight of dry pulp is consumed during the two stages.

9 Claims, No Drawings

PROCESS FOR A TWO STAGE PEROXIDE BLEACHING OF PULP

BACKGROUND OF THE INVENTION

The present invention pertains to the hydrogen peroxide bleaching treatment of chemical pulps.

The unbleached chemical pulps or cellulose pulps obtained by digesting cellulose-containing materials according to the so-called sulfite or sulfate or Kraft process with soda or carbonate need to be bleached so that the products obtained may have the quality required for their intended use.

The lignin content in the pulp, expressed by the kappa number in the trade, practically determines the global quantity of the chemical bleaching agent to be used.

The lower the initial kappa number, the more efficiently and economically the bleaching can be achieved in a limited number of stages.

The above-mentioned digestion processes unfortunately do not permit a low kappa number to be reached directly without marked deterioration of the mechanical properties of the cellulose fibers.

The application of chlorine and its oxidizing derivatives also fails to permit the direct reduction of the kappa number of the resinous wood chemical pulps to values close to 10 without the formation of intensely colored, polluting and corrosive effluents.

Also, in the case of resinous wood, hydrogen peroxide, an oxidizing agent which can be used most easily, only leads to kappa numbers between ca. 20 and 25 if applied directly to the chemical pulps in an alkaline medium.

A pretreatment in an acidic medium as was described, for example, in Japanese Patent Specification No. 1981-[Sho 76]102,103 or in French patent application published as No. 2,520,397 reduces this value to 15-20 but creates the above-mentioned difficulties due to the effluents which result from the alternation of the stages carried out in an acidic bath with stages carried out in an alkaline bath, which is implied by the method proposed.

SUMMARY OF THE INVENTION

The treatment according to the present invention overcomes the inconveniences of the prior art processes and provides pulps with kappa numbers as low as 10 or even lower from resinous wood chemical pulps with very high efficiency of the chemical agent used, i.e. hydrogen peroxide.

Briefly stated, the present invention comprises a two-stage hydrogen peroxide bleaching treatment of chemical pulp at a temperature of about 90°-100° C. comprising subjecting said pulp in a first stage to hydrogen peroxide and to at least about 3 grams/l of bath of a metal ion sequestering agent selected from nitrogen containing sequestering agents or agents derived from polyphosphoric or polyphosphonic acids of a pH of about 8.5 to 9.5 so that hydrogen peroxide of about 0.3 to 2.5 wt. % relative to dry pulp weight is consumed, and subjecting said pulp in a second stage to hydrogen peroxide and to at least about $3\times10^{-3}$ gram-atoms per 100 grams of dry pulp of magnesium in the form of magnesium hydroxide and a pH of at least about 11 so that about 2 to 5 weight % of hydrogen peroxide per weight of dry pulp is consumed during the two stages, and wherein the magnesium is present only in the second stage.

DETAILED DESCRIPTION

The instant process is characterized in that the resinous wood chemical pulp is subjected to the action of hydrogen peroxide at temperatures between about 90° C. and 100° C. in two stages. The first stage is carried out at pH values between about 8.5 and 9.5, in the presence of at least one agent sequestering the metal ions which agent is selected from among the nitrogen-containing sequestering agents or the sequestering agents derived from polyphosphoric and polyphosphonic acids and taken in quantities equaling at least about 3 g/l bath, so as to consume hydrogen peroxide quantities between about 0.3 and 2.5 wt. % relative to the dry pulp weight. The second stage is carried out at a pH value of at least 11 in the presence of at least about $3\times10^{-3}$ gram-atoms of magnesium in the form of magnesium hydroxide, $Mg(OH)_2$ per 100 g dry pulp, so that the total hydrogen peroxide consumption on a weight basis will be between 2 and 5 wt. % relative to the dry pulp weight in the course of the two stages.

The nature of the chemical agent suitable for reaching the pH values specified for the first stage is not critical. However, the alkalizing agent selected must be neither oxidized nor reduced by hydrogen peroxide.

Several of these chemical agents can be simultaneously used providing that they do not react with one another. Sodium hydroxide and sodium carbonate satisfy the above definition and also, preferably, sodium tripolyphosphate, the sodium salt of ethylene diamine tetraacetic acid and the sodium salt of diethylene triamine pentaacetic acid.

It is preferable for the pH value to remain as constant as possible in the course of the said first stage, which is achieved by means of the known methods, e.g. by using buffers or by the continuous or intermittent addition of one or several chemical agents such as those specified above. Sodium tripolyphosphate, the sodium salt of ethylene diamine tetraacetic acid and the sodium salt of diethylene triamine pentaacetic acid are preferably used among the metal ion sequestering agents which are suitable according to the present invention. These three compounds, used separately or as a mixture, can thus act both as alkalizing and sequestering agents at the same time.

The duration of the first stage is generally less than four hours. Sodium hydroxide and sodium carbonate are particularly suitable as the alkaline agents which can be used to reach the pH value selected for the second stage. In the said second stage, the magnesium hydroxide may be introduced as is or as formed in the treatment bath from a magnesium salt such as the chloride, nitrate or sulfate, whose anion is inert with respect to hydrogen peroxide.

The duration of the second stage is generally between two and five hours.

The consistency is not a critical factor for carrying out the two stages of treatment according to the present invention. For practical and economic reasons, it is always preferable for the consistency to be between 3% and 25% and especially between 5% and 15%.

In the first and second stages alike, the quantity of hydrogen peroxide used is, of course, at least equal to the quantity that must be consumed and at most equal, in general, to 5 wt. % and preferably to ca. 3.5 wt. % relative to the dry pulp weight.

After the first treatment stage according to the present invention, the pulp can be separated from the bath liquor in the usual manner and be subjected to alkaline extraction in a known manner prior to the second stage of the treatment. This alkaline extraction, generally carried out at a temperature on the order of magnitude of 90° C. to 120° C., is preferably carried out in the majority of the cases. However, it remains optional and it may be advantageous not to carry it out at all, especially if the conditions selected for the first stage are such that the hydrogen peroxide used in this stage is almost completely consumed.

If the bath liquors of the two stages are separated from the pulp, the said respective liquors can be advantageously used to contribute to the formation of the respective baths in their initial composition.

The pulp treated according to the present invention may be bleached according to the usual processes, with improved economy and efficiency.

The conditions specified for carrying out the first stage are those which permit chemical pulps with kappa numbers generally lower than 15 to be obtained after the second stage, if the chemical pulp to be treated is a resinous wood chemical pulp. This makes it possible to carry out the treatment in a particularly economical manner, because of the increased effectiveness of the hydrogen peroxide.

The effectiveness will be designated below by the term Ef, defined as kappa/$H_2O_2$ consumed, in which the $H_2O_2$ consumed is the total quantity of hydrogen peroxide consumed in wt. % relative to the dry pulp weight and kappa is the difference between the kappa number of the untreated pulp and the kappa number of the pulp treated according to the present invention.

The treatment according to the present invention will be further described by the following examples which are set forth for purposes of illustration only.

In each of the examples, the quantities of the various compounds involved are stated in weight percent relative to the weight of the dry pulp. This does not apply, of course, to the consistency of the pulp.

In each of these examples, the conditions are those specified above, the pH value in the first stage being between 8.5 and 9.5, and the pH value in the second stage being at least equal to 11, just as in the comparative example.

EXAMPLE 1

A resinous wood chemical pulp with a kappa number of 28.5 and with a consistency of 5% is treated for two hours at 90° C. in the presence of 3.4% hydrogen peroxide, $H_2O_2$ and 41.4% sodium tripolyphosphate TPP.

The $H_2O_2$ consumption is thus 1.9% in this first stage.

After alkaline extraction, carried out within one hour at 90° C. in the presence of 20% sodium hydroxide NaOH, the pulp, which has a consistency of 5%, is subjected to the action of 2.7% $H_2O_2$ in the presence of 3.2% NaOH and 0.5% magnesium hydroxide $Mg(OH)_2$ at 90° C. for two hours.

The $H_2O_2$ consumption thus reaches 1.5% in this second stage.

The total $H_2O_2$ consumption is 3.4%, whereas the kappa number of the pulp treated is only 12.5, and Ef reaches 4.7.

EXAMPLE 2 (comparative example)

The same pulp as in Example 1 is subjected to the action of 3.4% $H_2O_2$ in the presence of 4% NaOH and 0.6% $Mg(OH)_2$ (the consistency being 5%) for two hours at 90° C.

The $H_2O_2$ consumption is complete, but the kappa number of the pulp treated is still 25, i.e. only slightly lower than the initial value.

The value of Ef is almost five times lower than in Example 1.

EXAMPLE 3

The same pulp as in Example 1 and with the same consistency as in that example is subjected:

(i) to treatment in a first stage under the following conditions:

| | |
|---|---|
| temperature: | 90° C. |
| duration: | two hours |
| $H_2O_2$: | 1.7% |
| TPP: | 17.2%, |

(ii) to an alkaline extraction under the same conditions as in Example 1, and (iii) to a second stage treatment under the following conditions:

| | |
|---|---|
| temperature: | 90° C. |
| duration: | three hours |
| $H_2O_2$: | 1.7% |
| NaOH: | 2.0% |
| $Mg(OH)_2$: | 0.3% |

The $H_2O_2$ consumption is 1% in the first stage, 1.2% in the second stage, and the kappa number of the pulp treated is only 12.5, and the Ef value is 7.5 times that in Example 2.

EXAMPLE 4

A resinous wood chemical pulp with a kappa number equaling is treated at a consistency of 5% at 90° C. for one hour in the presence of 0.6% $H_2O_2$ and 17.2% TPP.

The $H_2O_2$ consumption is now complete.

At the same consistency and without alkaline extraction, the pulp is subjected in a second stage to the action of 2.7% $H_2O_2$ in the presence of 4% NaOH and 0.25% $Mg(OH)_2$ at 90° C. for five hours.

The $H_2O_2$ consumption is still complete.

The kappa number of the pulp treated is one-third that determined before the treatment, and the Ef value is ca. 7.

EXAMPLE 5

If we proceed in the same manner as in Example 3, but the alkaline extraction is carried out at 120° C. instead of 90° C., the kappa number of the pulp treated will be 10.5, and the total $H_2O_2$ consumption will be 2.0%. The Ef value will reach almost 9.0.

EXAMPLE 6

The chemical pulp to be treated, which is the same as that in Example 4 and has a consistency of 10%, is subjected:

(i) to treatment in a first stage under the following conditions:

| | |
|---|---|
| temperature: | 90° C. |
| duration: | two hours |
| $H_2O_2$: | 0.7% |

-continued

| | |
|---|---|
| TPP: | 3%, |

(ii) and, without intermediate alkaline extraction, and
(iii) to a treatment under the following conditions still at a consistency of 10%:

| | |
|---|---|
| temperature: | 90° C. |
| duration: | four hours |
| $H_2O_2$: | 3.4% |
| $Na_2CO_3$: | 21% |
| $Mg(OH)_2$: | 0.6% |

The $H_2O_2$ consumption is 0.3% in the first stage and is complete in the second stage.

After the treatment, the pulp has a kappa number of 15, and the Ef equals 5.

EXAMPLE 7

Example 4 is repeated, but the pH value in the first stage is reached with ethylene diamine tetraacetic acid and soda and is maintained at 9.5 by adding NaOH.

The results obtained are practically as those obtained in Example 4.

While the invention has been described in connection with certain preferred embodiments, it is not intended to limit the scope of the invention to the particular form set forth, but, on the contrary, it is intended to cover such alternatives, modifications, and equivalents as may be included within the spirit and scope of the invention as defined by the appended claims.

What is claimed is:

1. A two-stage hydrogen peroxide bleaching treatment of chemical pulp at a temperature of about 90°-100° C. comprising:

a. subjecting said pulp in a first bleaching stage to hydrogen peroxide and at least about 3 grams/l of bath of a metal ion sequestering agent selected from nitrogen containing sequestering agents or derived from polyphosphoric or polyphosphonic acids at a pH of about 8.5 to 9.5 so that hydrogen peroxide of about 0.3 to 2.5 wt. % relative to dry pulp weight is consumed; and b. subjecting said pulp in a second bleaching stage to hydrogen peroxide and to at least about $3\times10^{-3}$ gram-atoms per 100 grams of dry pulp of magnesium in the form of magnesium hydroxide and a pH of at least about 11 so that additional hydrogen peroxide is consumed in said second stage and about 2 to 5 weight % of hydrogen peroxide per weight of dry pulp is consumed during the two stages and wherein said magnesium is present only in said second stages.

2. The process of claim 1 wherein the first stage pH of about 8.5 to 9.5 is obtained from a chemical agent selected from sodium hydroxide, sodium carbonate, sodium tripolyphosphate, or the sodium salts of either ethylene diamine tetraacetic acid or diethylene triamine pentaacetic acid.

3. The process of claim 1 wherein the first stage pH is maintained at a constant value.

4. The process of claim 1 wherein the sequestering agent is selected from sodium tripolyphosphate, or the sodium salt of either ethylene diamine tetraacetic acid or diethylene triamine pentaacetic acid.

5. The process of claim 1 wherein the second stage pH is obtained from sodium carbonate or sodium hydroxide.

6. The process of claim 1 wherein about 0.5 to 2 wt. % hydrogen peroxide per wt. of dry pulp is consumed during the first stage and about 2 to 3.5 wt. % per weight of dry pulp of hydrogen peroxide is consumed during both stages.

7. The process of claim 1 wherein no more than about 5 wt. % hydrogen peroxide per dry weight pulp is used for each stage.

8. The process of claim 7 wherein the quantity of hydrogen peroxide used does not exceed 3.5 weight % per weight dry pulp.

9. The process of claim 1 wherein an alkaline extraction step at about 90° C. to 120° C. is carried out after said first stage and before said second stage.

* * * * *

UNITED STATES PATENT AND TRADEMARK OFFICE

CERTIFICATE OF CORRECTION

PATENT NO. : 4,734,161

DATED : March 29, 1988

INVENTOR(S) : Dubreux

It is certified that error appears in the above-identified patent and that said Letters Patent is hereby corrected as shown below:

Column 4, line 39, after "equaling" insert --33--.

Column 6, Claim 1, line 12, "stages" should read --stage--,

Signed and Sealed this

Nineteenth Day of July, 1988

*Attest:*

*Attesting Officer*

DONALD J. QUIGG

*Commissioner of Patents and Trademarks*